US006062155A

United States Patent [19]

Corlett

[11] Patent Number: 6,062,155

[45] Date of Patent: May 16, 2000

[54] MAST MOUNTED BOOM SUPPORT FOR SAILBOATS

[76] Inventor: Edwin H. Corlett, 42 Elmwood Ct., Indian Head Park, Ill. 60525

[21] Appl. No.: 09/320,747

[22] Filed: May 27, 1999

[51] Int. Cl.[7] ..... B63B 15/00

[52] U.S. Cl. ..... 114/97; 114/39.21; 114/99

[58] Field of Search ..... 114/89, 90, 91, 114/97, 102.1, 39.12, 39.21, 39.29, 39.11

[56] References Cited

U.S. PATENT DOCUMENTS 358,673 3/1887 Johnson ..... 114/39.1

4,655,154 4/1987 Leonard ..... 119/91

5,070,802 12/1991 Corlett ..... 114/99

5,431,121 7/1995 Canepa ..... 114/102.15

*Primary Examiner*—Ed Swinehart

[57] ABSTRACT

A boom support for supporting a sailboat boom on all sailing angles. The boom support, which is pivotally attached to the lower portion of the mast below the boom, includes two resiliently flexible rods extending from the mast attachment upwardly and outwardly to the boom. A flexible strip of webbing between the two rods counteracts the boom weight and is held in place by a line attached to the gooseneck. The boom is free to lift clear of the boom support.

5 Claims, 2 Drawing Sheets

MAST MOUNTED BOOM SUPPORT FOR SAILBOATS

BACK GROUND OF THE INVENTION

1. Field of the Invention

The invention relates to a sailboat boom and more particularly to a mast mounted support for a sailboat boom.

2. Description of the Prior Art

Since the beginning of sailing, boom supports of one form or another have been used on sailboats using a fore and aft rig incorporating a boom. They were for use only when the sail was down. When raised, the sail supported the boom and the boom support was removed or made non supportive. An innovative boom support, the mechanical vang, appeared on the market a number of years ago. A vang is an adjustable rigging, usually a block and tackle, between the boom and the mast below the boom to keep the boom from raising when sailing on a reach or down wind. A vang only pulls, it cannot push. The mechanical vang was introduced to also provide push so that if the sail was lowered or the weight of the boom compromised the sail shape in light airs, the boom would be supported to negate these problems. This is fine for most large boats but will not work on many small boats because their boom is not mechanically fixed to the mast. The gooseneck, the connection between the mast and the boom, on these boats has a pin that fits into an axial hole in the end of the boom so that boom can easily be removed from the mast when not in use. When in use, the vang holds the boom onto the pin because of its angular relationship to the boom and the upward force provided by the sail thereby providing a force along the boom's axis toward the mast. If a mechanical vang is used, the boom would not stay on the gooseneck pin unless some other means is used rather than the mechanical vang. The reason the boom will not stay on the gooseneck pin is that when the upward force of the sail is removed as when the sail is lowered, the mechanical part of the mechanical vang is pushing with a force equal to the pulling part of the incorporated vang and because of this it provides no force along the boom to keep it on the gooseneck pin.

Another problem with the mechanical vang was that it incorporated both a vang and a boom support into one device. Many sailboats already have a vang and buying a mechanical vang meant they had to throw away their existing vang.

The present invention is directed to overcoming the problems discussed above.

SUMMARY OF THE INVENTION

The invention provides a simple mast mounted boom support that can be used with all booms regardless how they are affixed at the gooseneck. Used in conjunction with an existing vang and/or main sheet while sailing, the device allows the skipper to adjust the height of the boom to obtain desired sail shape. While not sailing, the device supports the boom to keep it above the hull and cockpit.

The device attaches to the aft side of the mast below the boom by use of a swivel so that it can freely follow the movement of the boom. Two slender, resilient rods extend angularly up and out from the swivel in the direction of the boom. Between the upper ends of these rods is a flexible sling upon which the boom rests. To keep the sling from slipping out along the boom, a line is tied between the sling and the mast. The boom is free to lift out of the sling if such an occasion is required and if the boom is pulled down with sufficient force against the support sling, the flexible, resilient rods will bend rather than break, maintaining a lifting force against the boom while it is being adjusted to a lower position. It should be noted that the lifting force follows the Euler equation for slender columns and remains relatively constant over the boom's downward travel which is an advantage over the commonly used springs which require progressively more effort the further the boom is lowered. The lifting force can be adjusted by substituting rods of different diameters and the length can be adjusted by reducing the length of the rods with a hack saw.

The object of the invention is to provide a mast mounted boom support that will work with sailboats on all points of sailing regardless of how their booms are affixed to the mast.

DESCRIPTION OF THE PREFERRED EMBODIMENTS

Figure 1:
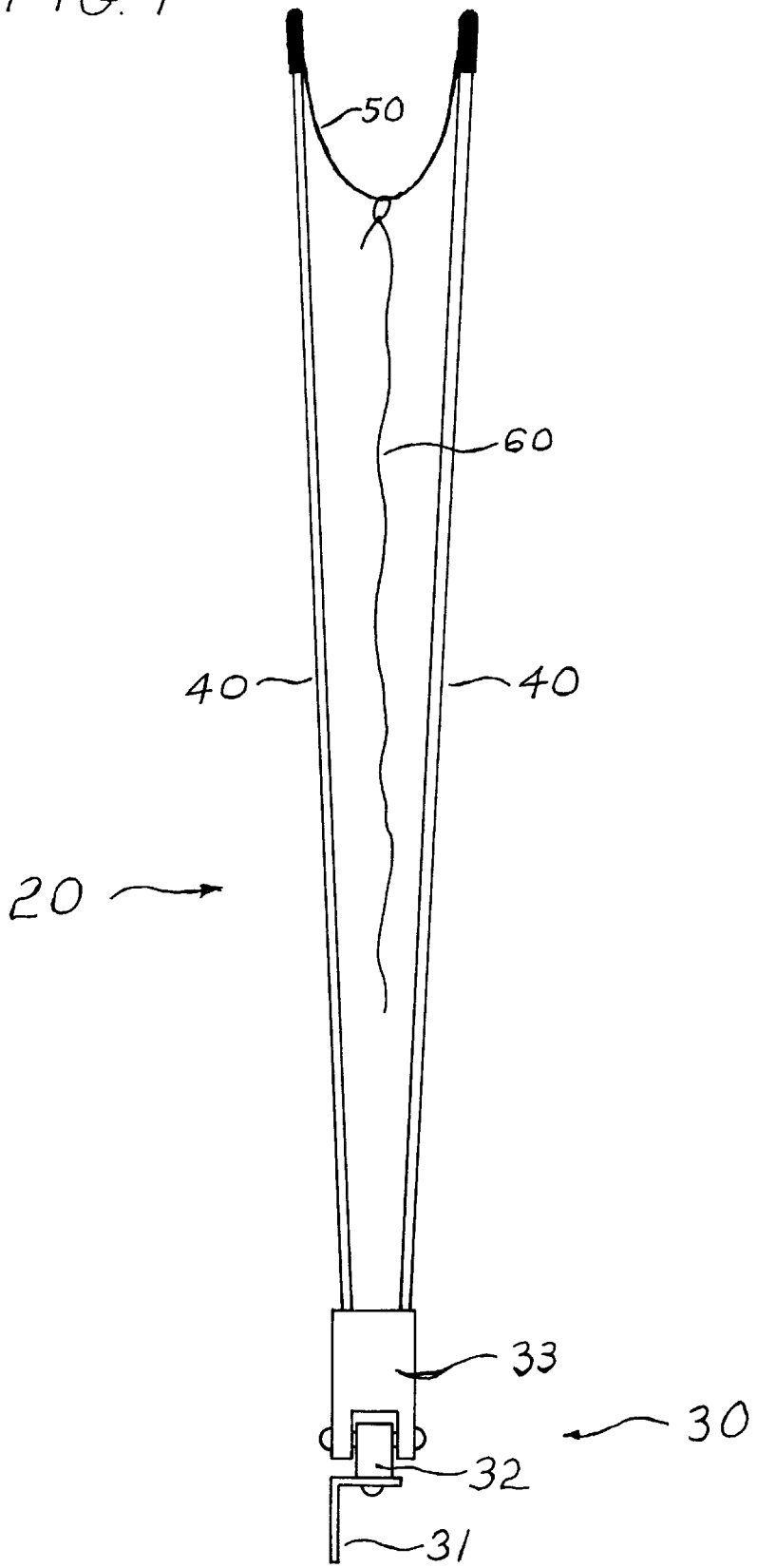
FIG. 1 is a detailed view of the boom support of the present invention.

A boom support, generally designated 20, of the present invention is shown in FIG. 1. It consists of a pivotal connection 30, two resiliently flexible rods 40, a flexible strip of webbing 50 and a line 60. The pivotal connection 30 is attached to the mast with a bracket 31, has a swivel joint 32 so that it can follow the boom through its maximum travel from side to side of the sailboat and an upper member 33 which has holes for holding the two resiliently flexible rods 40. The two resiliently flexible rods 40 are of sufficient diameter to be stiff enough to support the boom with its sail when the sail is down and stopped to the boom. When added downward force is applied to the boom such as with the main sheet or vang, the two resiliently flexible rods 40 follow the Euler equation for slender columns and bow out of column while maintaining a relatively constant return force. The top ends of the two resiliently flexible rods 40 have a flexible strip of webbing 50 fastened between them for supporting the boom. The flexible strip of webbing 50 has formed pockets sewn into each end which respectively fit over the top ends of the two resiliently flexible rods 40. This allows the downward force of the boom to be applied to the two resiliently flexible rods 40. However, because the boom support 20 is angularly attached to the mast, any downward force on the flexible strip of webbing 50 will be accompanied with an outward force on the flexible strip of webbing 50 along the axis of the boom. This outward force is counteracted by a line 60 attached between the flexible strip of webbing 50 and the gooseneck. This leaves the boom support 20 in a stable configuration.

Figure 2:
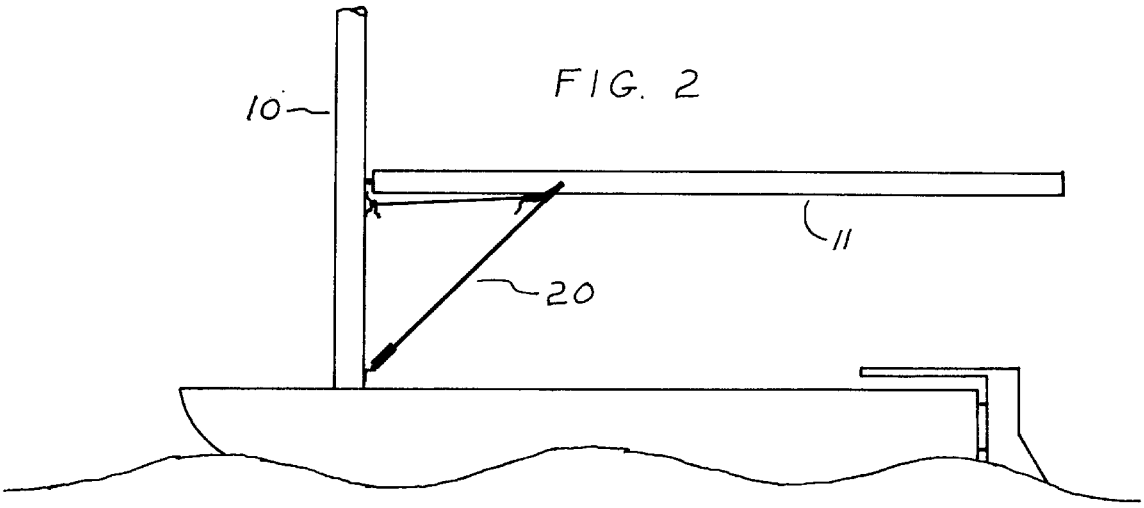
FIG. 2 is a representation of a sailboat with a boom support of the present invention supporting the boom.
Figure 3:
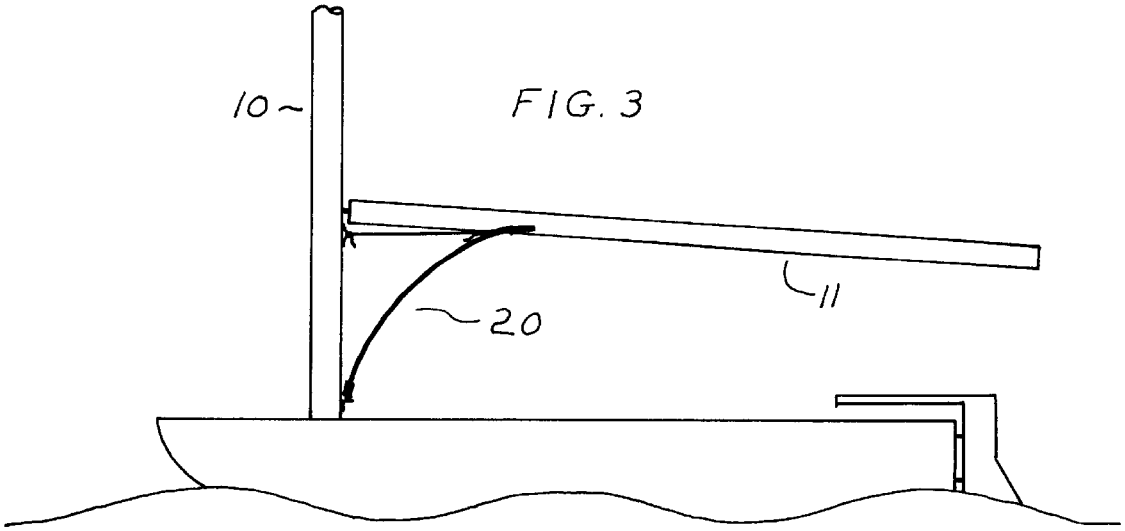
FIG. 3 is a representation of a sailboat with a boom support of the present invention showing the boom support with the boom forced down below its position in FIG. 2.
Figure 4:
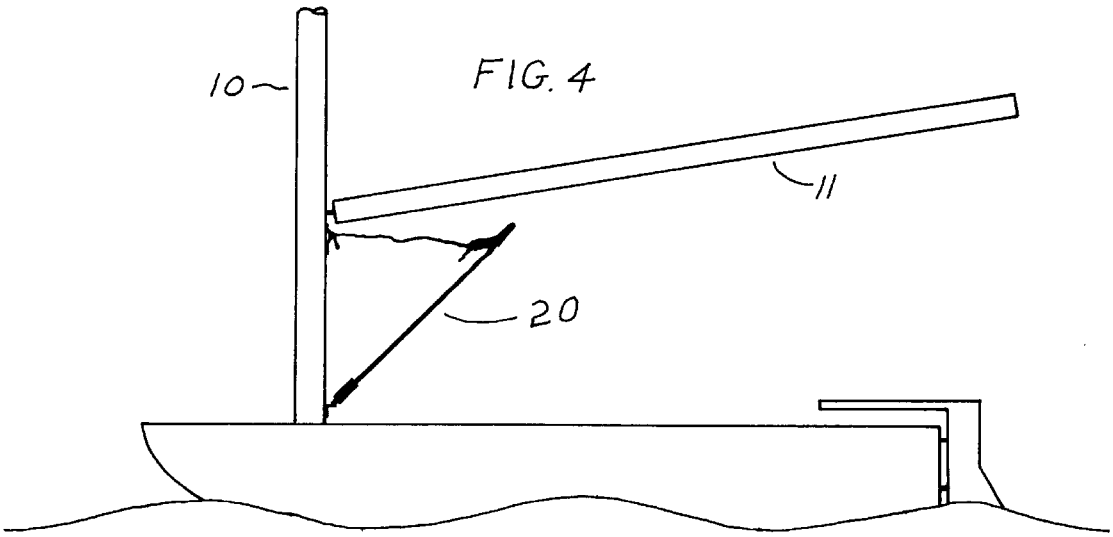
FIG. 4 is a representation of a sailboat with a boom support of the present invention where the boom has been lifted above its position in FIG. 2.

FIG. 2, FIG. 3 and FIG. 4 illustrates a sailboat with the boom support 20 of this invention pivotally connected to the mast 10 and the boom 11 in three different attitudes with respect to the boom support 20. FIG. 2 shows the boom 11 resting on the boom support 20. FIG. 3 shows the boom 11 forced down below its position in FIG. 2 thereby causing the boom support 20 to flex but still support the boom 11. FIG.

4 shows the boom 11 lifted clear of the boom support 20 illustrating that there is no attachment between the boom 11 and the boom support 20.

Although only one preferred embodiment of this invention has been disclosed it will be understood that various changes and modifications may be made without departing from the spirit and scope of this invention as defined in the appended claims.

I claim:

1. A boom support for supporting a sailboat boom pivotally connected to the lower portion of a sailboat mast below the boom, comprising an elongate member having first and second end portions, the first end portion having attachment means for swingable connection to the lower portion of the mast below the boom and the second end portion having a means of counteracting the weight of the boom at a location spaced outwardly and upwardly from the first end portion without restricting the boom from lifting above and free of the second end portion.

2. A boom support as specified in claim 1 in which the elongate member is comprised of two juxtaposed elongate resiliently flexible rods with their respective second end portions adapted to be positioned on opposite sides of the boom and the means of counteracting the weight of the boom secured between their respective second end portions.

3. A boom support as specified in claim 2 in which the means of counteracting the weight of the boom is a flexible strip of webbing with formed pockets at opposite ends which fit over the two second end portions of the flexible rods and a line with means to hold the strip of webbing from slipping along the boom away from the mast as the boom weight is applied to the boom support.

4. A boom support as specified in claim 3 in which the line is adapted to be attached to the gooseneck.

5. A boom support as specified in claim 4 in which the flexible rods are stiff enough to support the weight of the boom and its accessories but will bow rather than break when too much downward force is applied to the boom.

* * * * *